US005849123A

United States Patent [19]

Rice

[11] Patent Number: 5,849,123

[45] Date of Patent: Dec. 15, 1998

[54] APPARATUS AND METHOD FOR ALIGNING WEBS

[75] Inventor: Brian Scott Rice, Fairport, N.Y.

[73] Assignee: Eastman Kodak Company, Rochester, N.Y.

[21] Appl. No.: 575,943

[22] Filed: Dec. 20, 1995

[51] Int. Cl.[6] ..... B65H 19/00

[52] U.S. Cl. ..... 156/64; 156/157; 156/351; 156/361; 156/363; 156/502; 156/504; 226/20; 242/554.1; 242/555.1

[58] Field of Search ..... 156/64, 157, 159, 156/351, 361, 362, 363, 502, 504, 505; 226/2, 19, 20, 21, 22, 23; 242/554.1, 555.1

[56] References Cited

U.S. PATENT DOCUMENTS

| | | | |
|---|---|---|---|
| 3,786,974 | 1/1974 | Kron | 226/19 |
| 3,834,971 | 9/1974 | Johnson | 226/19 X |
| 4,003,511 | 1/1977 | Schwestka | 226/20 X |
| 4,878,986 | 11/1989 | Nishikawa | 156/504 |
| 4,888,717 | 12/1989 | Ditto et al. | 156/361 X |
| 4,892,611 | 1/1990 | Wheeler et al. | 156/504 |
| 5,098,507 | 3/1992 | Mao | 156/351 |

FOREIGN PATENT DOCUMENTS 0 167 917 A 1/1986 European Pat. Off. .

*Primary Examiner*—James Engel
*Attorney, Agent, or Firm*—Clyde E. Bailey, Sr.

[57] ABSTRACT

Apparatus and method for aligning webs, such as photographic film or paper, where the trailing edge of an expiring web is spliced to the lead edge of a fresh web. A supporting means having the fresh web thereon in a fixed position is caused to move by sensor means transmitting a signal corresponding to precise positioning of the expiring relative to the fixed position of the fresh web. According to the invention, a programmable controller is used to analyze the signals received from the sensors and directs the movements of the supporting means where the webs are ultimately moved into abutting or overlapping contact and then spliced.

19 Claims, 11 Drawing Sheets

APPARATUS AND METHOD FOR ALIGNING WEBS

TECHNICAL FIELD

The invention relates generally to an apparatus and method for aligning flexible material, such as webs. More particularly, the invention concerns an apparatus and method for aligning while conveying a trailing end of a first, expiring web with a leading end of a second, fresh web so that a spliced web is substantially free of edge weave and the like when conveyed.

BACKGROUND OF THE INVENTION

Apparatus for splicing flexible material, such as web, are well known in the art. In a typical apparatus and method for splicing the ends of webs, the web ends are cut while generally in an overlapping or abutting relations. One end of one of the webs is separated while being conveyed so that the two cut ends to be joined can be maneuvered into abutting or overlapping relations with one another. Splice tape is then applied to the abutting or overlapping ends to form the spliced web.

A problem with existing web splicing operations is that in most continuous web processing machines, the conveyance of webs prior to splicing oftentimes results in misalignment between the web ends. Poor geometric alignment, i.e,. skew 10 and offset 12 (illustrated in FIG. 1), of the spliced webs 102, 104 will invariably produce coating edge registration problems. Illustrated in FIGS. 2 and 3, respectively, are the effects of misaligned spliced webs 102, 104 and an aligned spliced web on coating registration. One of the most common results of weave is coating registration problems, as shown in FIG. 2. Experience has shown that weave, occurring generally along lateral edge portions of the joined webs, is caused by the lateral motion of a moving web perpendicular to its direction of motion and in the plane defined by the width of the web. Thus, it is generally established that lateral edge weave is induced by splice misalignment (offset and skew). While prior art developments have not addressed the problem of web alignment, there are exists some developments that teach web splicing generally, and in particular, disclose various means of cutting the new and expired webs and then joining of the two webs with, for instance. tape, glue, heat seal for both butt and lap splices. As examples, U.S. Pat. Nos. 4,892,611 and 4,878,986 each discloses limiting operator intervention in the cutting and joining phase of the splice operation. Neither of these references evinces concern or appreciation for geometric alignment of the new and expired web as a means for resolving the weaving of one web relative to the other prior to splicing.

Therefore, a need persists for an apparatus and method for aligning adjoining ends of webs in (high speed) conveying operations so as to eliminate the possibility of misaligned web segments prior to splicing.

SUMMARY OF THE INVENTION

It is, therefore, an object of the invention to provide an apparatus for aligning webs prior to splicing so as to virtually eliminate splice induced weave.

It is another object of the invention to provide a spliced web wherein the lateral alignment can be specified in terms of offset, lateral displacement of the expired and new web edges and skew, and the local angle between the two web edges (edge parallel to the machine direction of travel).

It is yet another object of the invention, to provide an apparatus capable of geometrically aligning the trailing edge of an expiring web and the leading edge of a new web in continuously operating web converting machines prior to the splice operation.

It is an advantageous effect of the present invention that the apparatus and method minimize splice induced weave and eliminates waste associated therewith.

It is a feature of the invention that lateral edges of an expiring web and fresh web are aligned by position metrics detected by sensors which communicate with a controller that processes the signals and transmits a signal to a movable support means bearing the fresh web. The movements of the support means registrably aligns the fresh web with the expiring web.

To accomplish these and other objects and advantages of the invention, there is provided, in one aspect of the invention, an apparatus for moving a first, fresh web into registered alignment with a second, expiring web. According to this embodiment, means is provided for movably supporting the fresh web in a prearranged fixed position. A first sensor means in proximity to the supporting means and arranged to detect the fresh web is employed to detect both the rotational and lateral metrics of the fresh web in its fixed position. Similarly, a second sensor means in proximity to the supporting means is used to detect the plurality of positions of the expiring web as it is being positioned in proximity with the supporting means. Each of the sensor means produces signals that are received and processed by a controller means having a microprocessor which compares the positions of the expiring and fresh webs and transmits a third signal corresponding to precisely sensed positions of the expiring web relative to the fixed position of the fresh web. Thus, the third signal provides the supporting means with movements that registrably aligns the fresh web with the expiring web.

In another aspect of the invention, a method for moving a first, fresh web into registered alignment with a second, expiring web, comprises the step of movably supporting the fresh web in a fixed position. The movably supporting means is capable of movements in response to a signal corresponding to the sensed positions of the expiring web relative to the fixed position of the fresh web. Sensors are used for generating signals corresponding to the positions of the fresh web and the expiring web, as described above. A controller means receives and processes these signals. Thereafter, the controller means transmits a third new signal that provides the supporting means with movements that registrably aligns the fresh web with the expiring web.

BRIEF DESCRIPTION OF THE DRAWINGS

The foregoing and other objects, features and advantages of the invention will be apparent from the following more particular description of the preferred embodiments of the invention, as illustrated in the accompanying drawings.

DETAILED DESCRIPTION OF THE INVENTION

Figure 1:
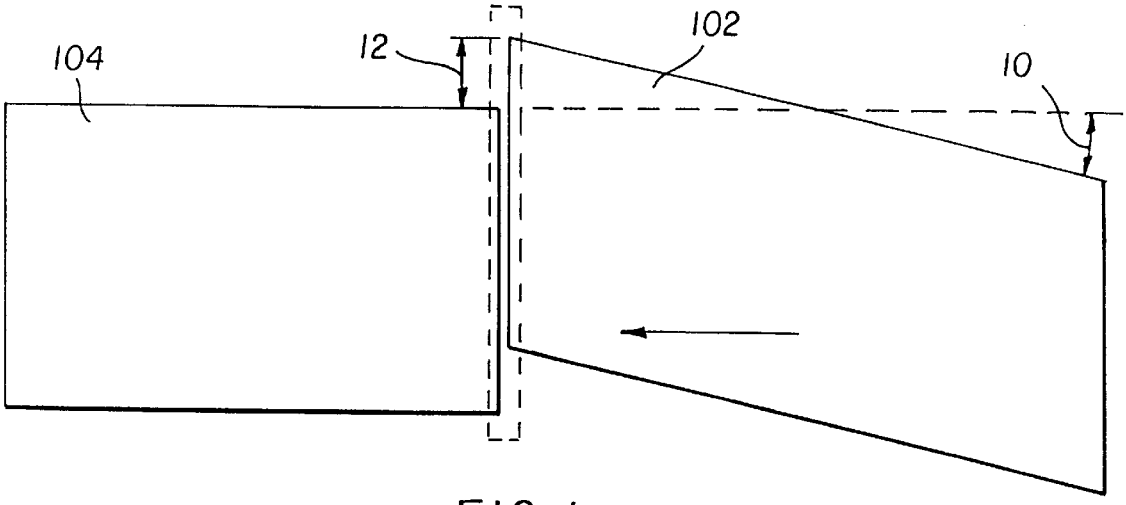
FIG. 1 is a top plane view of misaligned web ends prior to splicing.
Figure 2:
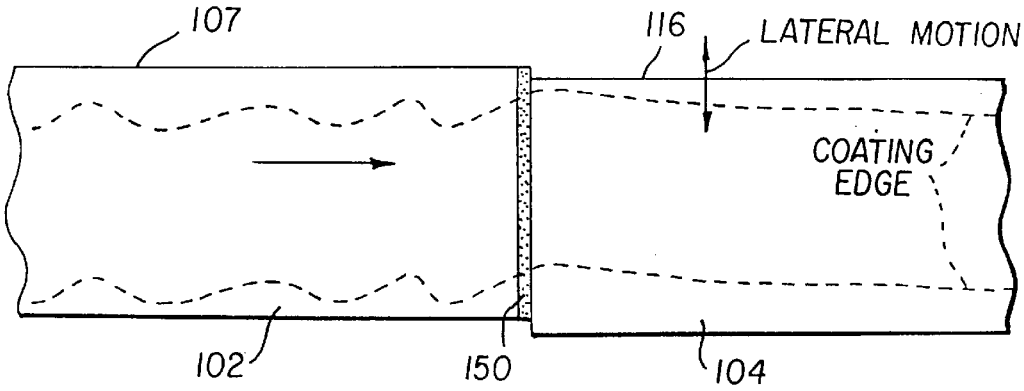
FIG. 2 is top plane view of a misaligned spliced web.
Figure 3:
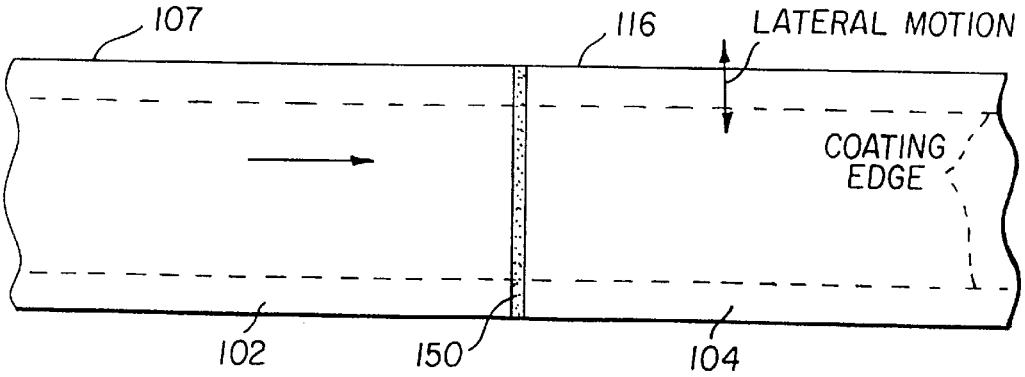
FIG. 3 is a top plane view of an aligned spliced web.
Figure 4:
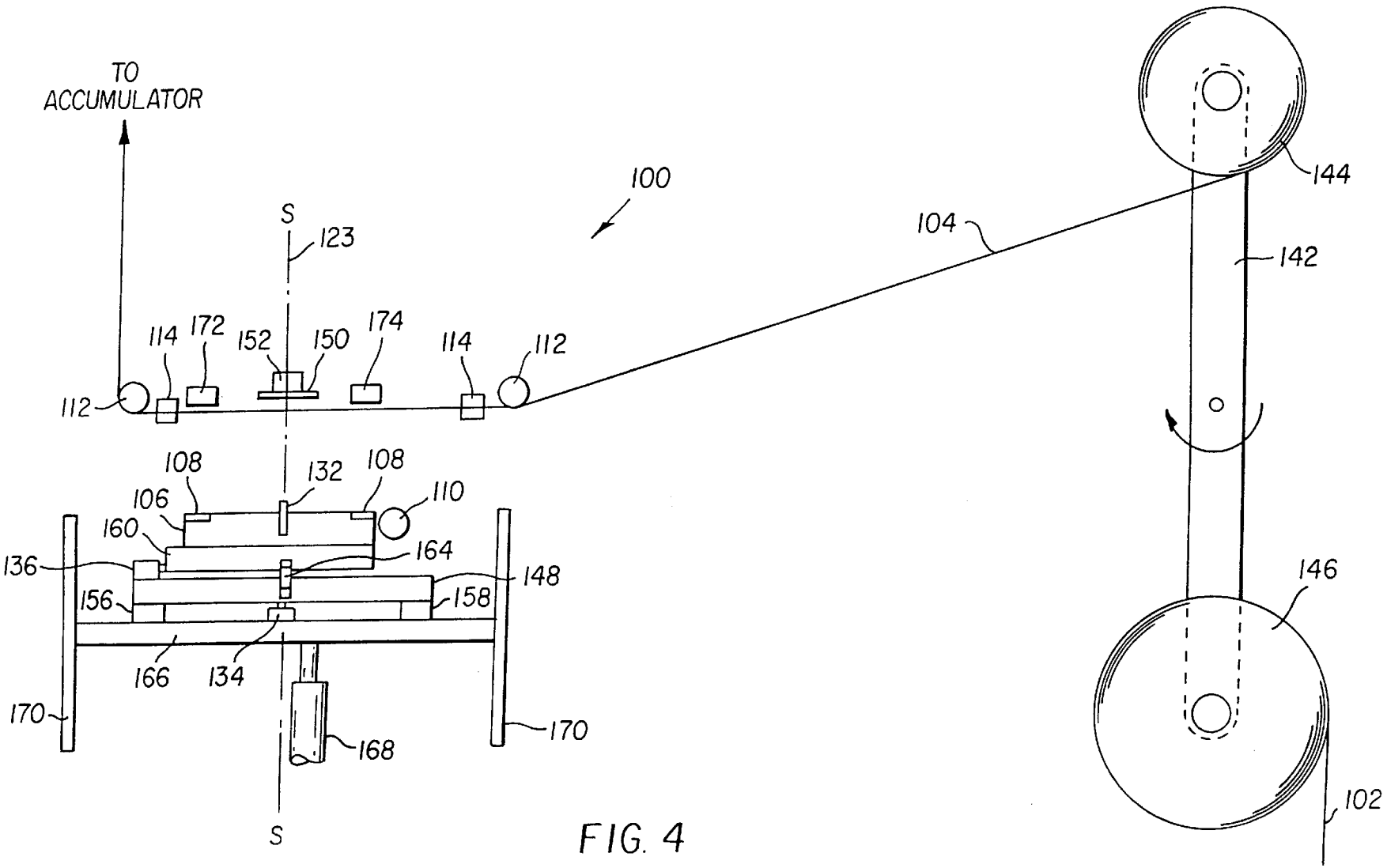
FIG. 4 is a side elevational view of the web splicing apparatus of the invention.
Figure 5:
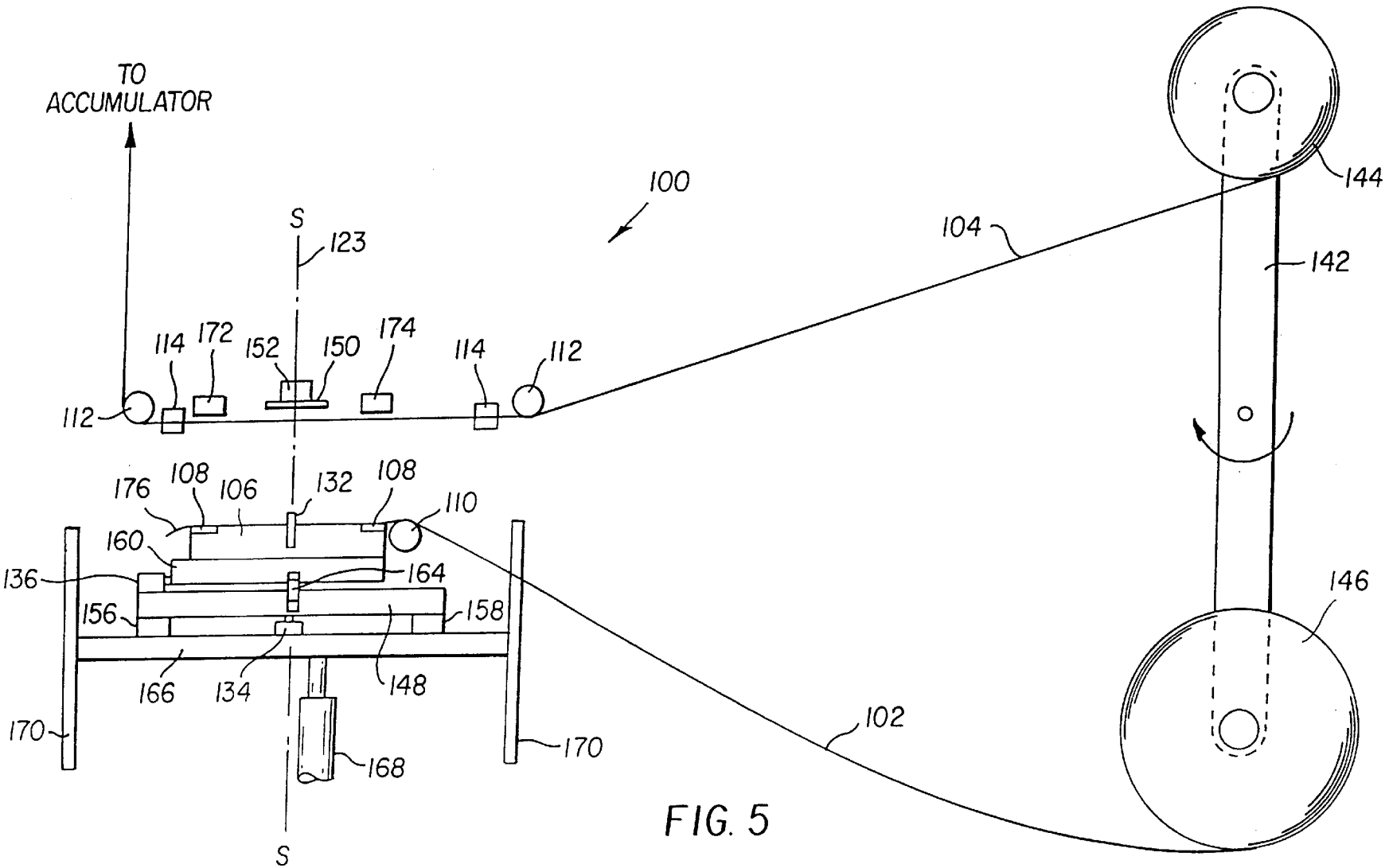
FIG. 5 is a side elevational view of the web splicing apparatus of the invention illustrating slack in the fresh web.
Figure 6:
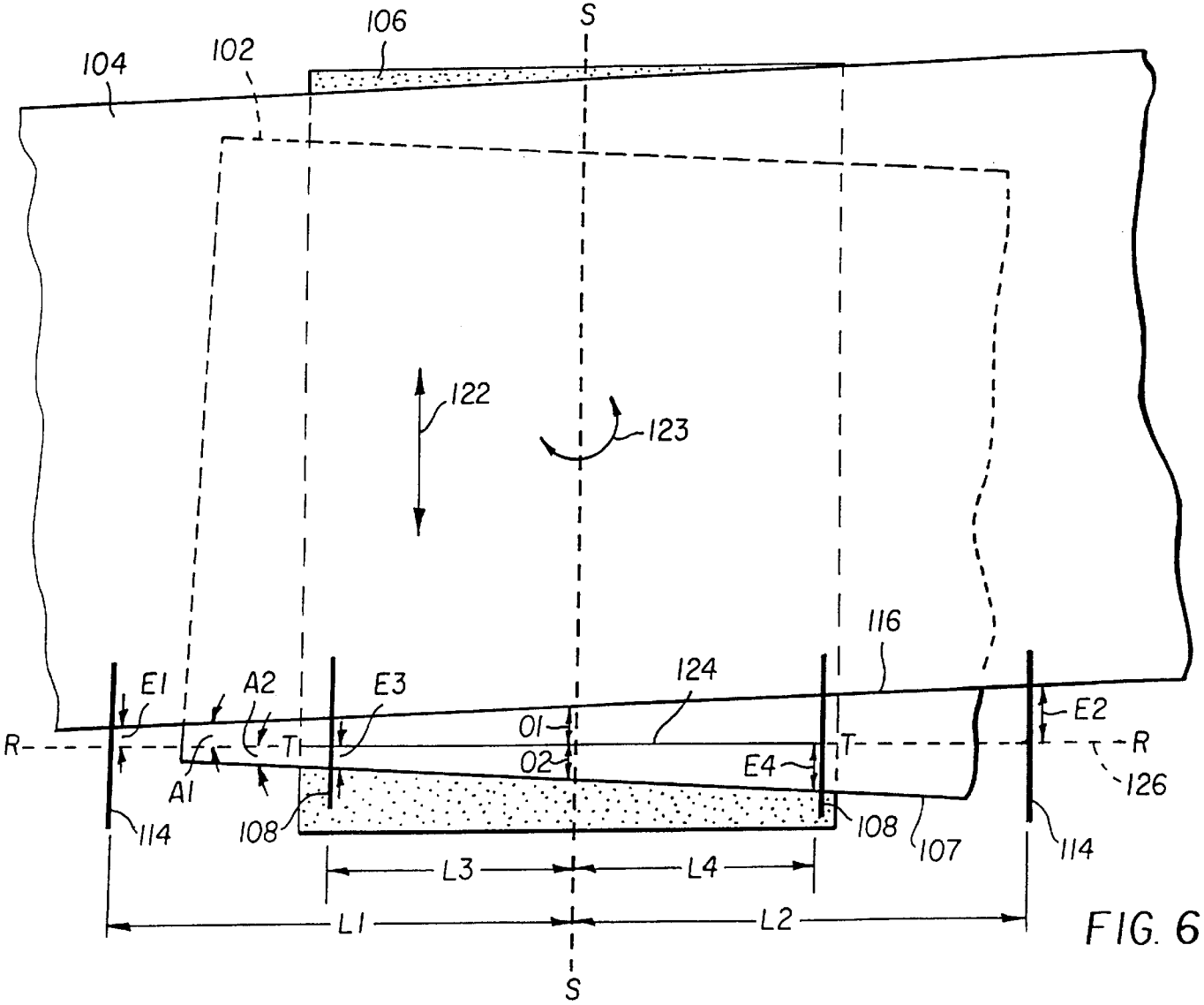
FIG. 6 is a top plane view of the fresh and expiring webs in the proximity of the vacuum table.

Turning now to the drawings, and particularly to FIGS. 4, 5, and 6, the apparatus 100 of the invention is illustrated. Broadly defined, the apparatus, or web splicing machine, 100, for positioning a first, fresh web 102 into registered alignment with a second, expiring web 104. According to this embodiment, means 106 is provided for movably supporting the fresh web 102 in a prearranged fixed position, as described in details below.

According to FIGS. 4 & 5, supporting means, preferably a partially ported vacuum table, 106, is employed for holding the fresh web 102 in its fixed position prior to splicing to an expiring web 104. Movements of the supporting means, or vacuum table, 106, while supporting the fresh web 102 correspond to precisely sensed positions of the expiring web 104 relative to the fixed position of the fresh web 102, as further described herein.

FIGS. 4, 5, & 6, moreover depict a pair of first sensor means 108 positioned in proximity to the supporting means, or vacuum table, 106, and arranged to detect the fixed position of the fresh web 102. Preferably a first sensor means 108 is arranged on either end portion of the vacuum table 106 so as to precisely sense a lateral edge 107 of the fresh web 102 in its fixed position. Thus, the rotational and translational metrics of this fixed position are detected or sensed by both first sensor means 108. Referring to FIG. 5, the stationary fresh web 102 is illustrated under zero tension on the machine 100 traveling along a path over idler roller 110, first sensor means 108 and then attached to vacuum table 106 where it will be spliced to the expiring web 104. Placement of the fresh web 102 in a prearranged fixed position on the movable vacuum table 106 is accomplished manually or by a machine process step. Positioning of the expiring web 104 in proximity of the vacuum table 106 where it is to be spliced to the fresh web 102 is achieved by conveying it from expiring web roll 144.

Referring again to FIGS. 4, 5, & 6, similarly, a pair of second sensor means 114 positioned in proximity to the supporting means 106 is used to detect the rotational and translational metrics corresponding to the plurality of positions of the expiring web 104 as it is positioning in proximity to the support means 106. Preferably, second sensor means 114 are arranged on opposite end portions of the vacuum table 106 for precisely sensing the lateral edge 116 of the expiring web 104. Each of the first and second sensor means 108, 114 produces signals that are received and processed by a programmable controller means 118 having a microprocessor which compares the positions of the expiring web 104 to the fixed position of the fresh webs 102, and then transmits a third signal corresponding to precisely sensed positions of the expiring web 104 relative to the fixed position of the fresh web 102. More importantly, this third signal provides the supporting means 106 with movements that registerably aligns the fresh web 102 to the expiring web 104. In this embodiment of the invention, it is the corresponding lateral edges 116, 107 of the expiring web 104 and fresh web 102, respectively, that are aligned as a result of the movements of the support means 106 bearing the fresh web 102.

It is important to the invention that fresh web 102 is under zero tension (producing what is commonly referred to as slack web) during the alignment process, as illustrated in FIG. 5. Slack web is important because it provides the necessary degrees of freedom (including translational and rotational) of the vacuum table 106 as it tracks precisely the positioning of the expiring web 104. Moreover, slack web prevents excessive forces from developing in the fresh web 102 due to bending stiffness of a tensioned web. Further, without slack web, the possibility of creasing the fresh web 102 and/or causing the fresh web 102 to move relative to the vacuum table 106 would exist. Such a development would clearly exacerbate the web aligning process as defined by the present invention.

According to FIG. 6, a top plan view vacuum table 106 of machine 100 showing second sensor means 114 for detecting the lateral edge 116 of the expiring web 104, first sensor means 108 for detecting the fixed position of the fresh web 102 on the vacuum table 106, and the fresh and expiring webs 102, 104 in proximity to the vacuum table 106. Vacuum table 106 provides a platform for splicing. To facilitate alignment, an edge indicator reference (T—T) 124 is provided on the vacuum table 106 (e.g. a mechanical feature). Prior to the fresh web 102 being affixed to the vacuum table 106, the vacuum table 106 is in its initial starting position with respect to translation axis 122 and rotation axis 123 axis. Thus, edge indicator reference (T—T) 124 is coincident with machine edge reference (R—R) 126. The edge indicator reference (T—T) 124 is provided to aid the operator in placing the fresh web 102 as close as possible to machine edge reference (R—R) 126 prior to the vacuum being applied to the vacuum table 106 for holding the fresh web 102. Further according to FIG. 6, rotation and translation of the vacuum table 106 provides movements for maneuvering the lateral edge 107 of fresh web 102 into alignment with the lateral edge 116 of the expiring web 104, as sensed by their respective sensor means 108. Alignment of the fresh web 102 with the expiring web 106 takes place just after the expiring web 106 reaches zero speed. Alternatively, one of ordinary skill in the art will appreciate that the alignment can occur just prior to the expiring web 106 reaching zero speed.

While the invention has thus far been generally described with reference to web edge alignment, extension of the inventive concept to centerline web alignment is within the contemplation of the invention.

Figure 7:
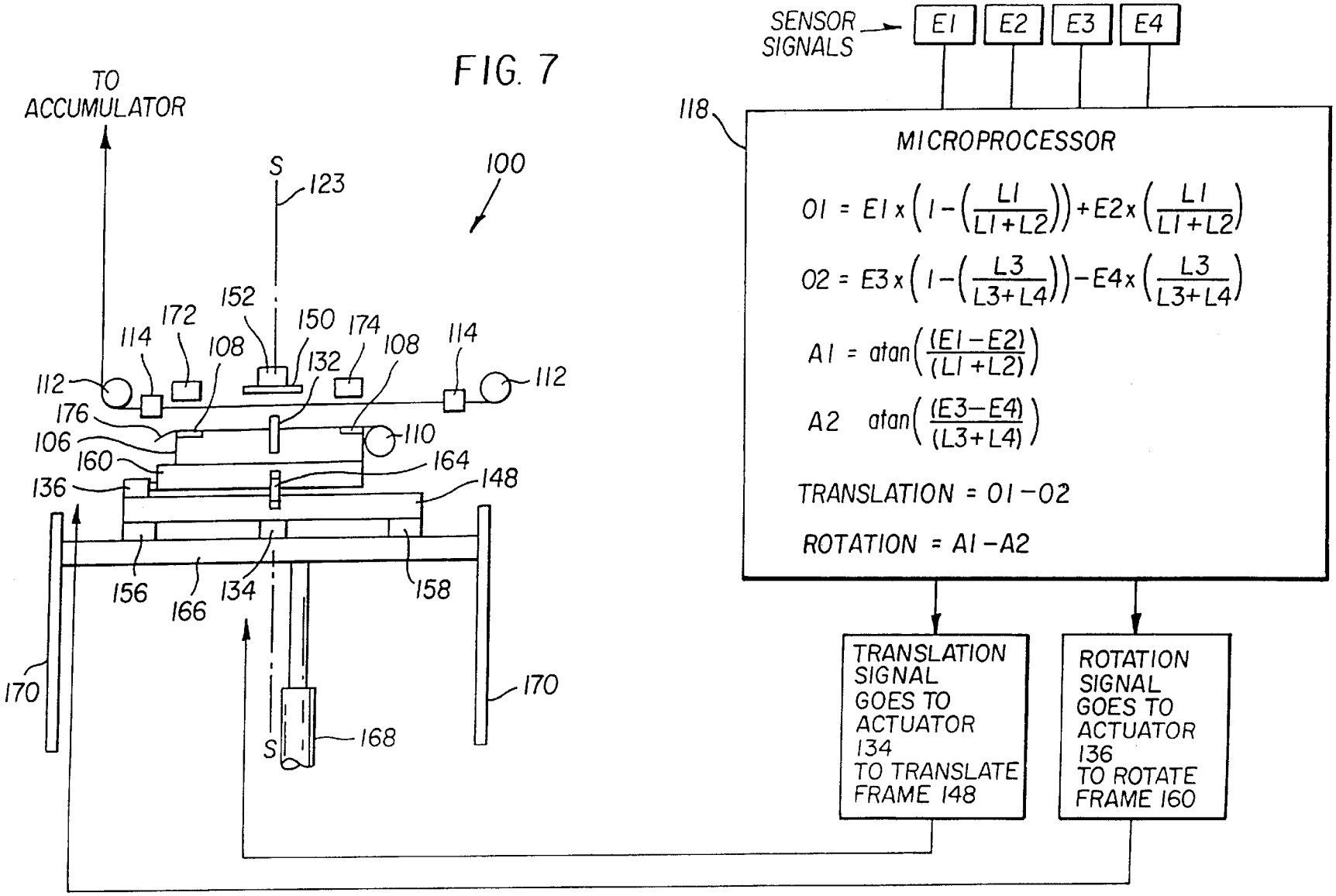
FIG. 7 is a side elevational view of the apparatus showing the control means of the invention.
Figure 8:
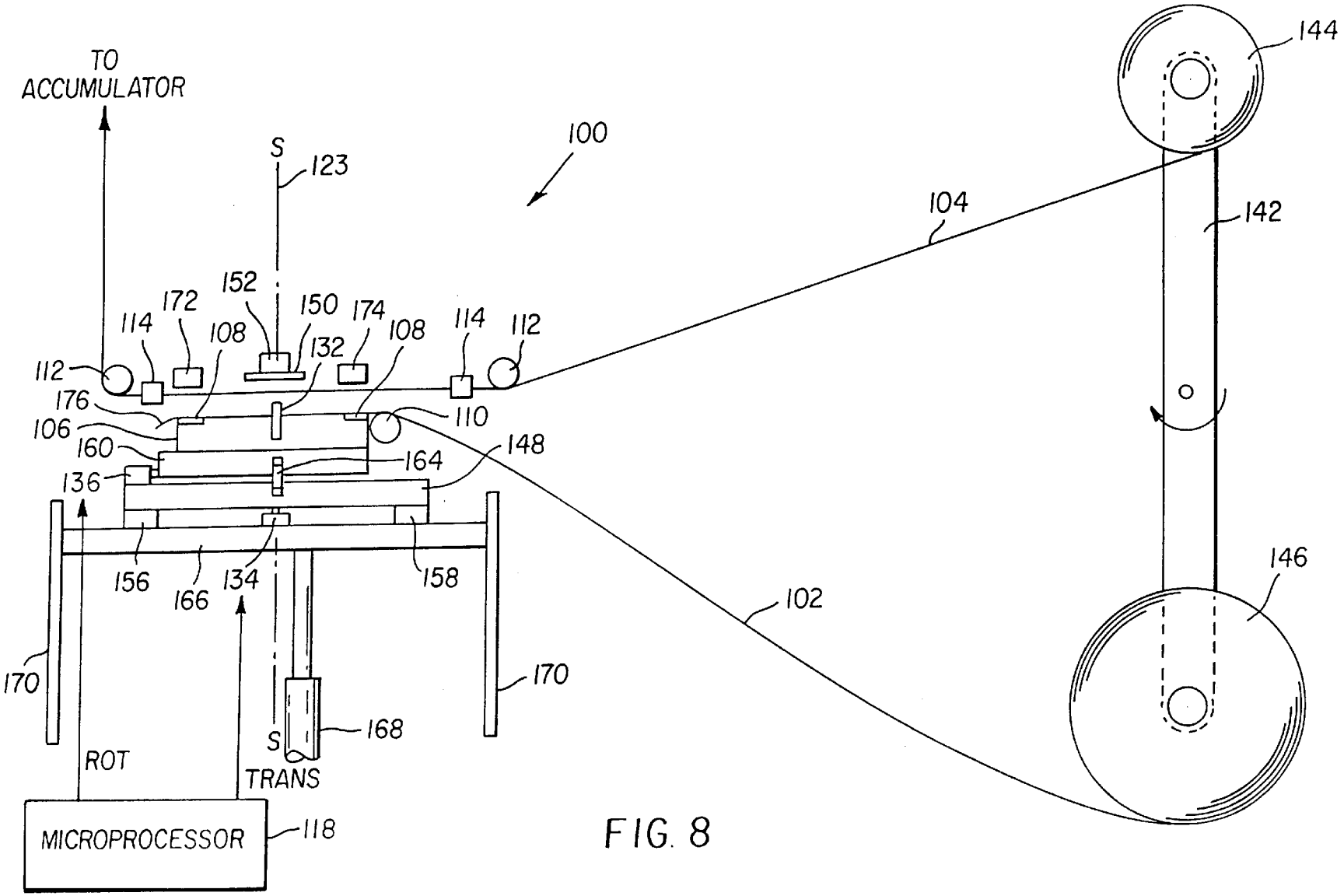
FIG. 8 is an alternative embodiment of the apparatus of the invention.

Referring next to FIGS. 7 & 8, the arrangement of first and second sensor means 108, 114 are used to provide datum useful in determining how much the vacuum table 106 must move along its translation axis 122 and rotation axis 123 in order to bring the fresh web 102 into alignment with the expiring web 104. In FIG. 7, a pair of second sensor means 114 arranged for sensing the lateral edge 116 of expiring web 104, measures expiring web 104 position error ($E_1$). An opposed second sensor means 114 measures position error $E_2$ of expiring web 104. Similarly, a pair of first sensor means 108, as indicated above, detects the lateral edge 107 of fresh web 102. One of the two first sensors means 108 provides position error $E_3$ while the opposed first sensor means 108 provides position error $E_4$. Further, both webs have an offset error as shown in FIG. 6. Expiring web 104 has an offset error defined by ($O_1$) and the fresh web 102 has an offset error defined by ($O_2$). Each of these offset errors are calculated along an axis 130 passing through the cutting means, or knife, 132 [(36)]. Moreover, each of the webs are also subject to skew as described above. The skew error for expiring web 104 is defined by ($A_1$); and, the skew error for the fresh web 102 is defined by $A_2$. Furthermore, I have found that machine 100 is more efficient if the first sensor means 108 is spaced distances ($L_3$ and $L_4$) from axis 130 of the cutting means 132; and the second sensor 114 is spaced a distances ($L_1$ and $L_2$) from axis 130 of the cutting means 132. According to my convention, displacements above axis R—R 126 are considered positive, and those below are negative (see FIG. 6). Thus ($E_1$), ($E_2$) and ($O_1$) are positive and ($E_3$), ($E_4$) and ($O_2$) are negative. Furthermore, angles sloping downward from left to right are considered positive. Thus, ($A_2$) is positive and ($A_1$) is negative.

One skilled in the art, of course, will appreciate that first sensor means 108, as described herein, while preferred, are not necessary to detect the position of the fresh web 102 if the desired alignment accuracies can be accomplished with mechanical datums on the vacuum table 106 (e.g. a mechanical feature on the vacuum table 106 referred to as machine edge reference T—T 124.

Measuring the lateral edge 107 of fresh web 102 in offset and skew with respect to axis T—T 124 with first sensors means 108 and translating and rotating vacuum table 106 to bring the fresh web 102 into alignment with machine axis R—R 126 is also a possible method of alignment. Here the position of the expiring web 104 is ignored, thus there is a loss in splice alignment quality.

As indicated above, a programmable controller means 118 is used to analyze signals corresponding to positions of the expiring and fixed fresh webs 104, 102 (best seen in FIG. 7). The following equations can be programmed into a microprocessor for determining the movements of the support means or vacuum table 106, as described in details above:

$$O_1 = E_1\left(1 - \frac{L1}{L2 + L1}\right) + \frac{E2L1}{L2 + L1}$$

$$O_2 = E_3\left(1 - \frac{L3}{L4 + L3}\right) + \frac{E4L3}{L4 + L3}$$

$$A_1 = \mathrm{TAN}^{-1}\left(\frac{E1 - E2}{L1 + L2}\right)$$

$$A_2 = \mathrm{TAN}^{-1}\left(\frac{E3 - E4}{L3 + L4}\right)$$

$$TRANS = O_1 - O_2$$

$$ROT = A_1 - A_2$$

Thus, as shown more clearly in FIGS. 7, the controller means 118 calculates TRANS and ROT (as shown above) and sends the appropriate signals to first and second actuators 134, 136. Actuators 134, 136 govern the movements of the supporting means 106 to bring the fresh web 102 into alignment with the expiring web 104. Note the second order terms coupling vacuum table translation to vacuum table rotation are ignored in the alignment calculation.

Referring again to FIG. 6, if the lateral edge 116 of the expiring web 104 is coincident with the machine edge reference R—R 126, errors $E_1$ and $E_2$ will be zero for the second sensor means 114. On the other hand, if the lateral edge 107 of fresh web 102 is coincident with the machine edge reference (T—T) 124, errors $E_3$ and $E_4$ will be zero for first sensor means 108.

Accordingly, the preferred embodiment of our invention presents a continuously operating web converting machine which makes stationary web splices, as illustrated, for instance in FIGS. 4 & 5. Although not required, we prefer employing two mandrels for accommodating each of the stock rolls of fresh and expiring webs, a turret for selectively feeding a stockroll to the machine, a zero speed splicer, sensors to locate the fresh and expiring web and a method of web storage (accumulator), each being described in more details below.

Alternatively, machine 100 may include means for cutting 132, e.g. a knife or blade, fresh and expiring webs 102,104 so that just-cut ends of the webs can form either abutting web ends or overlapping web ends. In this embodiment, a just-cut end of the expiring web 104 is positioned into proximity with the just-cut end leading end of the fresh web 102 to form abutting or overlapping aligned web ends.

Referring again to FIGS. 4 & 5, although not required, an unwind turret 142 supports expiring web roll 144 from which is conveyed the expiring web 104; and fresh web roll 146 from which is conveyed fresh web 102. The expiring web 104 is conveyed over idler rollers 112 and through the pair of second sensor means 114. Splice material, preferably a tape, 150 is attached to tape dispenser head 152 for transferring to the abutting or overlapping web ends.

OPERATIONS

FIG. 8 illustrates the machine 100 in operation prior to the splice sequence. The expiring roll 144 starts its deceleration and the accumulator starts to close allowing the rest of the machine 100 to remain at line speed. Expiring web 104 at this point reaches zero speed. The pair of second sensors means 114 and measure translational and angular positions of the expiring web 104 and then sends this information to the controller means 118. Further the pair of first sensor means 108 measure translational and rotational positions of the fresh web 102 and send this information to the controller means 118. The controller means 118 calculates TRANS and ROT as shown in FIG. 7. Controller means 118 then transmits the appropriate signal to first actuator 134 to translate a distance TRANS calculated as shown above. First actuator 134 translates first frame 148 on first and second slides 156,158. Second frame 160 supporting the vacuum table 106 moves with first frame 148 and the vacuum table 106 moves with second frame 160. Thus, the vacuum table 106 translates as a result of the movements of first frame 148. Controller means 118 also transmits a signal to second actuator 136 so as to cause second frame 160 to rotate about central axis (S—S) 123 passing through a centerline of first and second frames 148,160. Second frame 160 rotates by an angle ROT, calculated as shown above. Moreover, second actuator 136 causes second frame 160 to rotate about pivot 164 or central axis 123; and, the vacuum table 106 moves with second frame 160. Thus, the vacuum table 106 rotates as a result of the rotation of second frame 160. These movements brings the fresh web 102 into alignment with the expiring web 104.

Further, according to FIG. 8, a third frame 166 arranged below the first and second frames 148,160 is depicted in a splice ready position. Third actuator 168 is used to lift third frame 166 on a plurality of similar guide rails 170 preferably four, into splice ready position. The expiring web 104, at this point, is being conveyed into proximity with the vacuum table 106.

Figure 9:
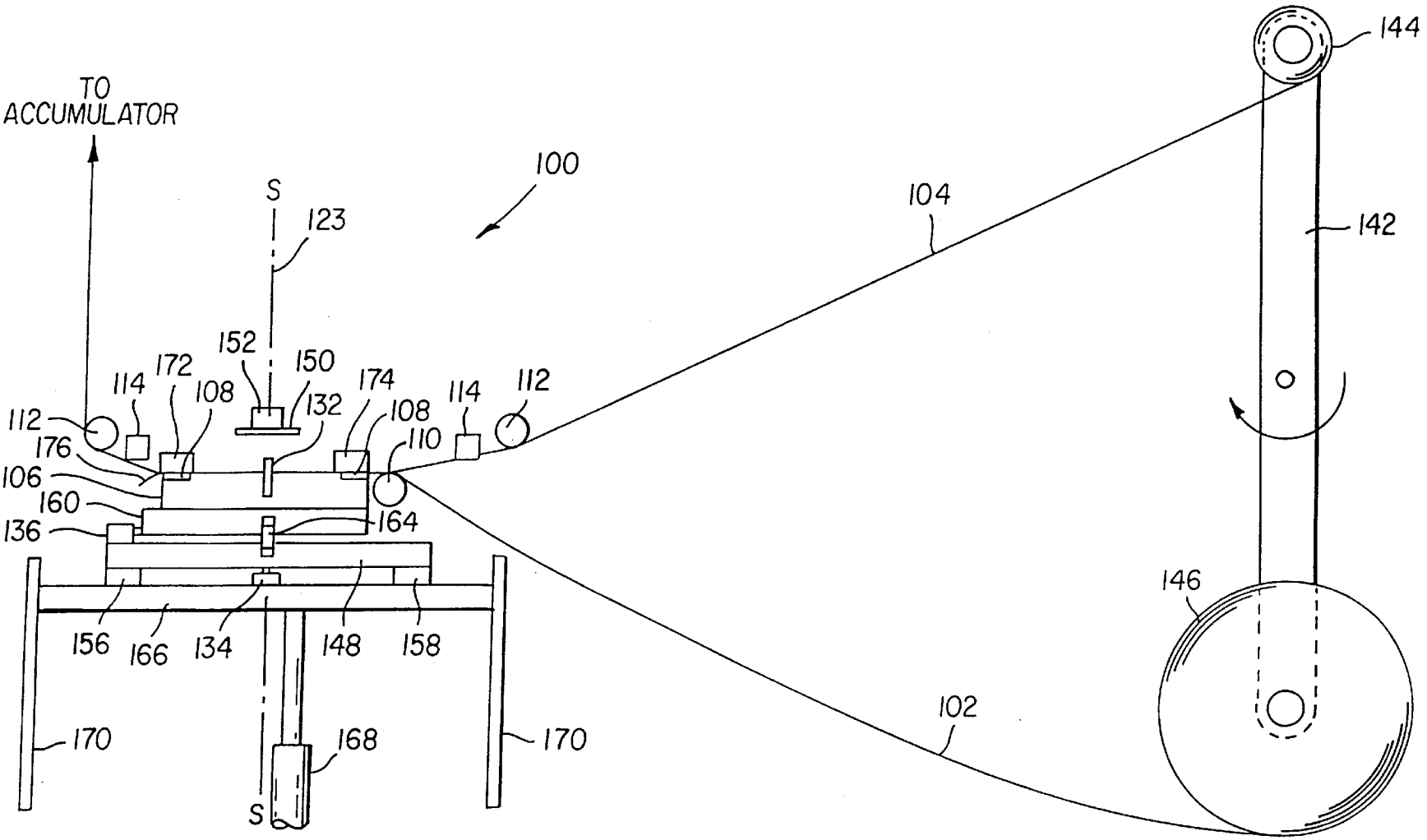
FIG. 9 is a side elevational view of the apparatus prior to a splice sequence; and, FIGS. 10–13 are side elevational views of the apparatus during a splice sequence.

In FIG. 9, the start of the splicing operation is illustrated. Clamps 172, 174 secure the fresh web 102 and the expiring web 104 to the vacuum table 106. A cutting means, or knife 132, [(36)] supported by the supporting means 106 transverses across the web widths cutting both the expiring and fresh webs 102, 104.

Figure 10:
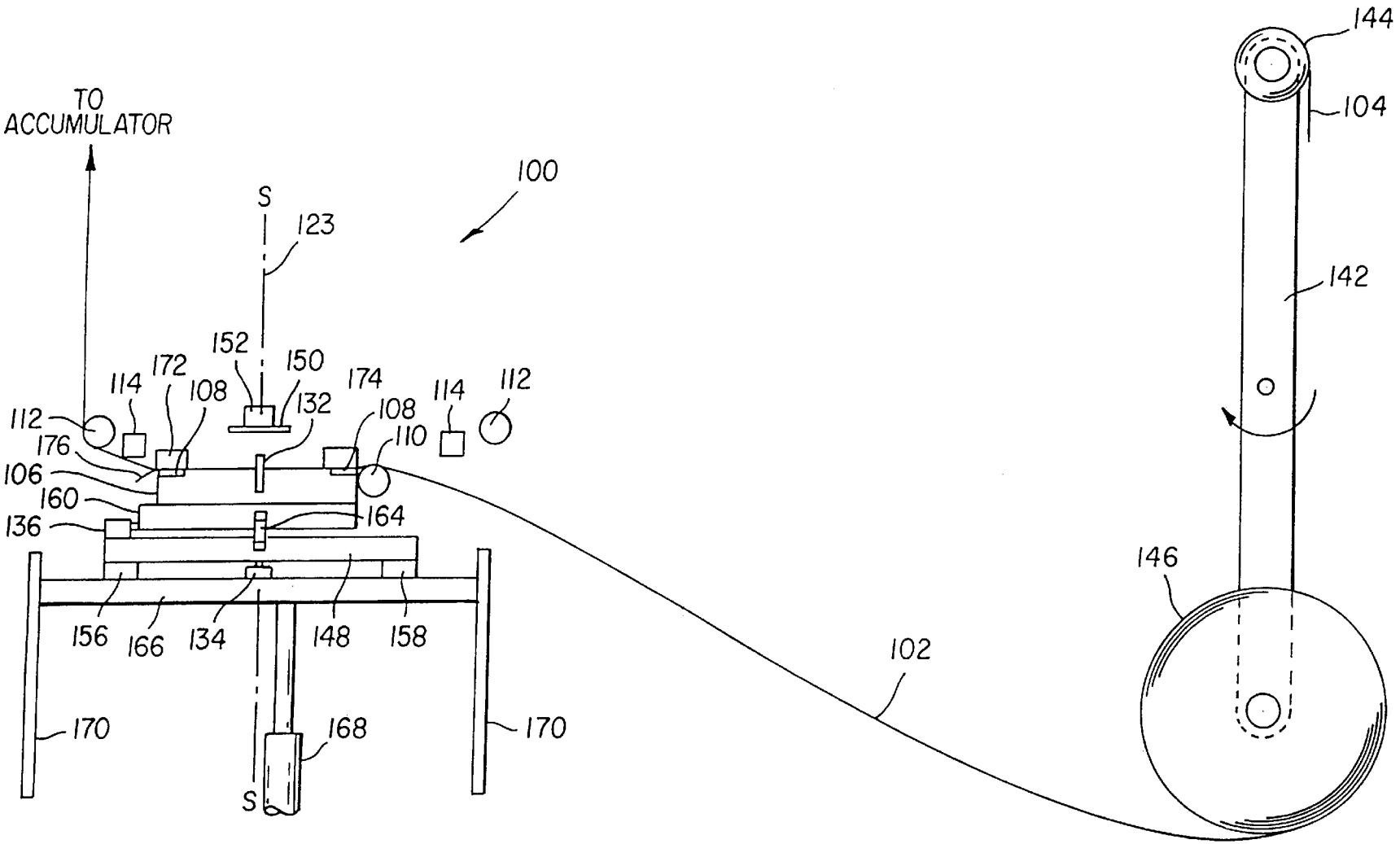

FIG. 10 depicts the steps needed to splice the fresh web 102 and expiring web 104 together. Clamp 174 retracts allowing the expiring web roll 144 to rewind pulling the unwanted portion of the expiring web 104 out of the way. Next tape head 152 applies the tape 150 to the just cut-ends of the expiring web 104 and the fresh web 102, thus producing the spliced web.

Figure 11:
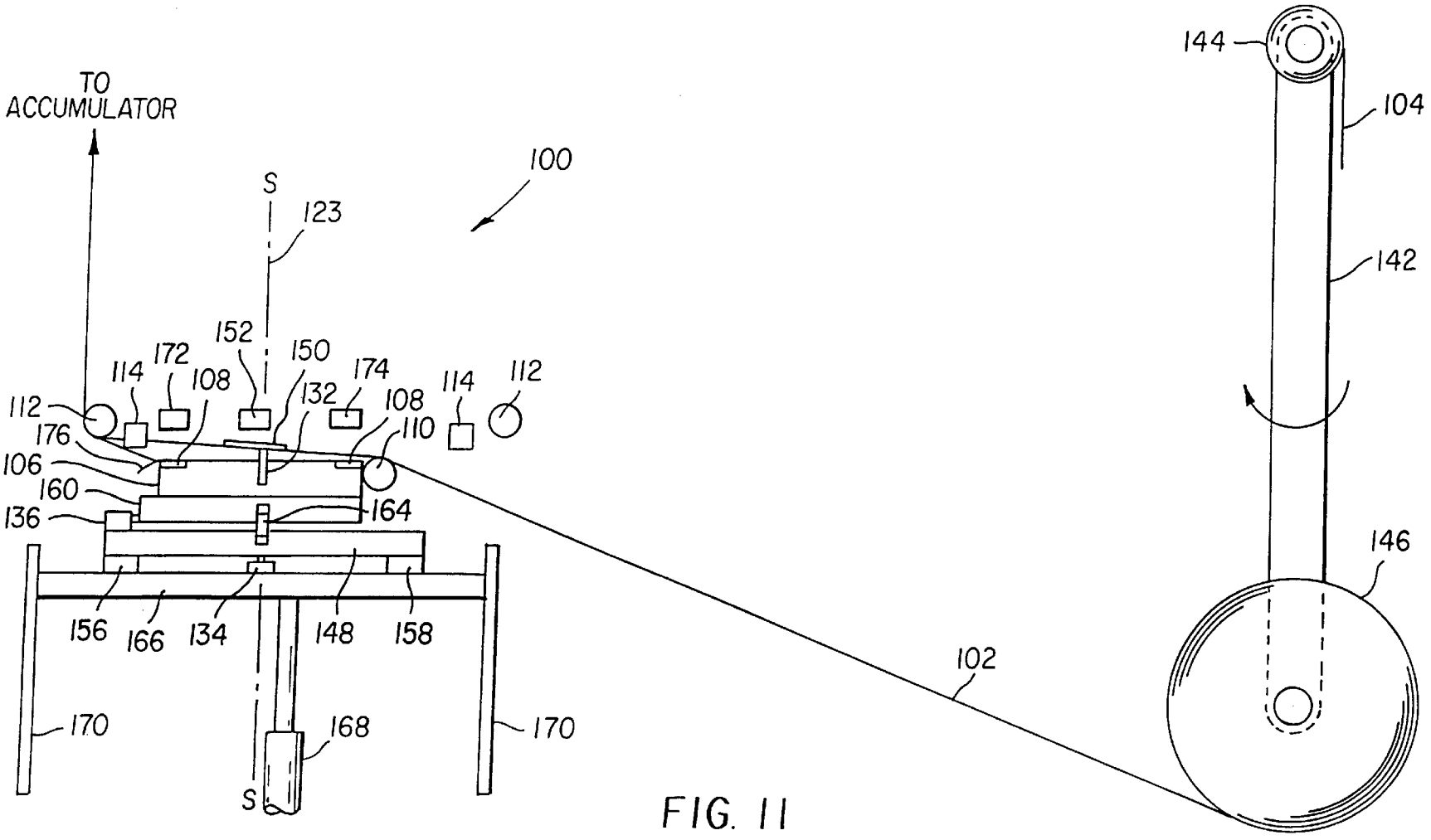

FIG. 11 illustrates the tape head 152 and clamp 172 retracting. Vacuum supplied to vacuum table 106 is turned off and the fresh web roll 146 rewinds removing the slack in the fresh web 102.

Figure 12:
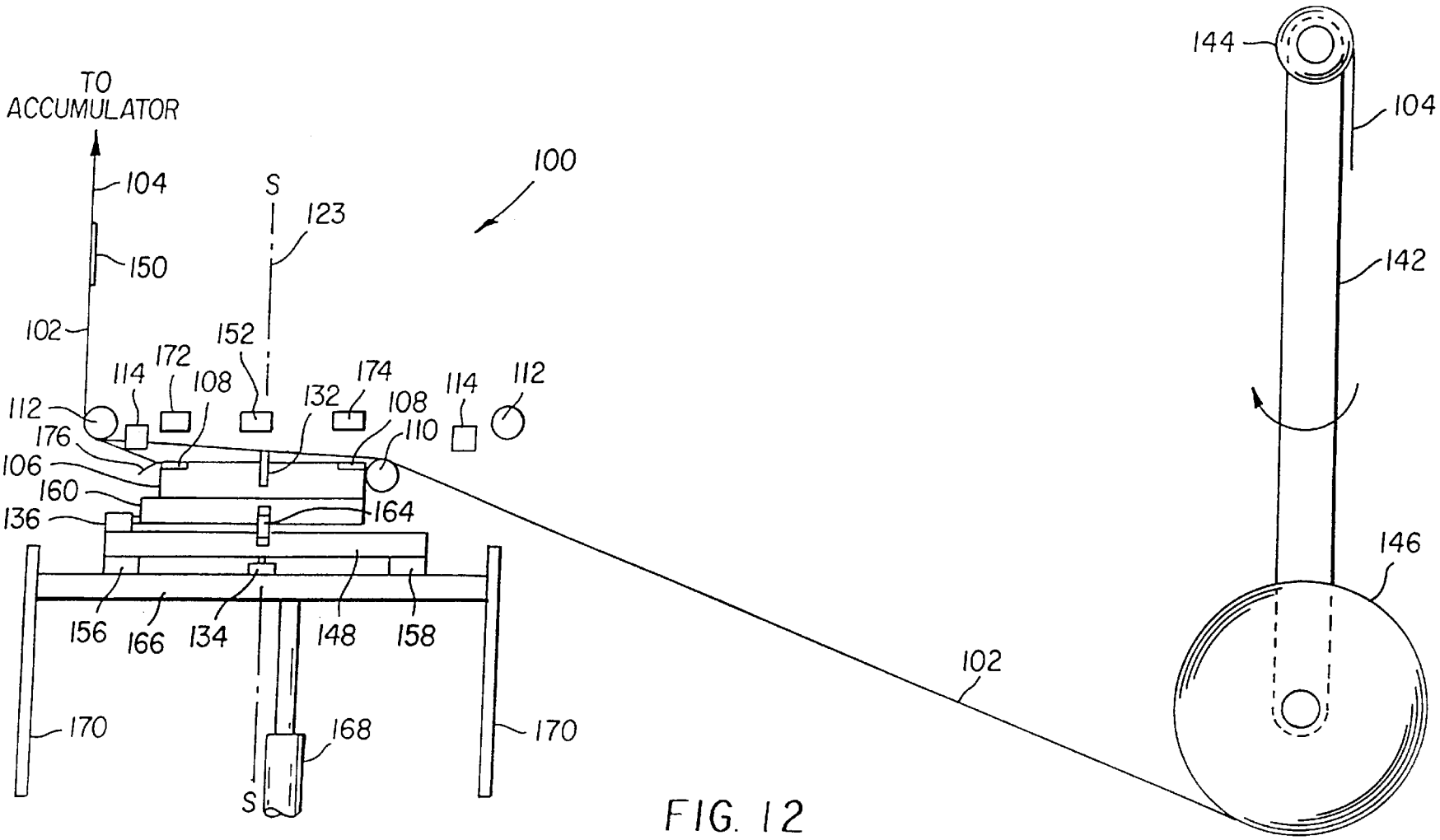

In FIG. 12, the start of web conveyance after the splice operation is illustrated. The fresh web roll 146 accelerates up to a speed greater than line speed allowing the accumulator (not shown) to fill with fresh web 102.

Figure 13:
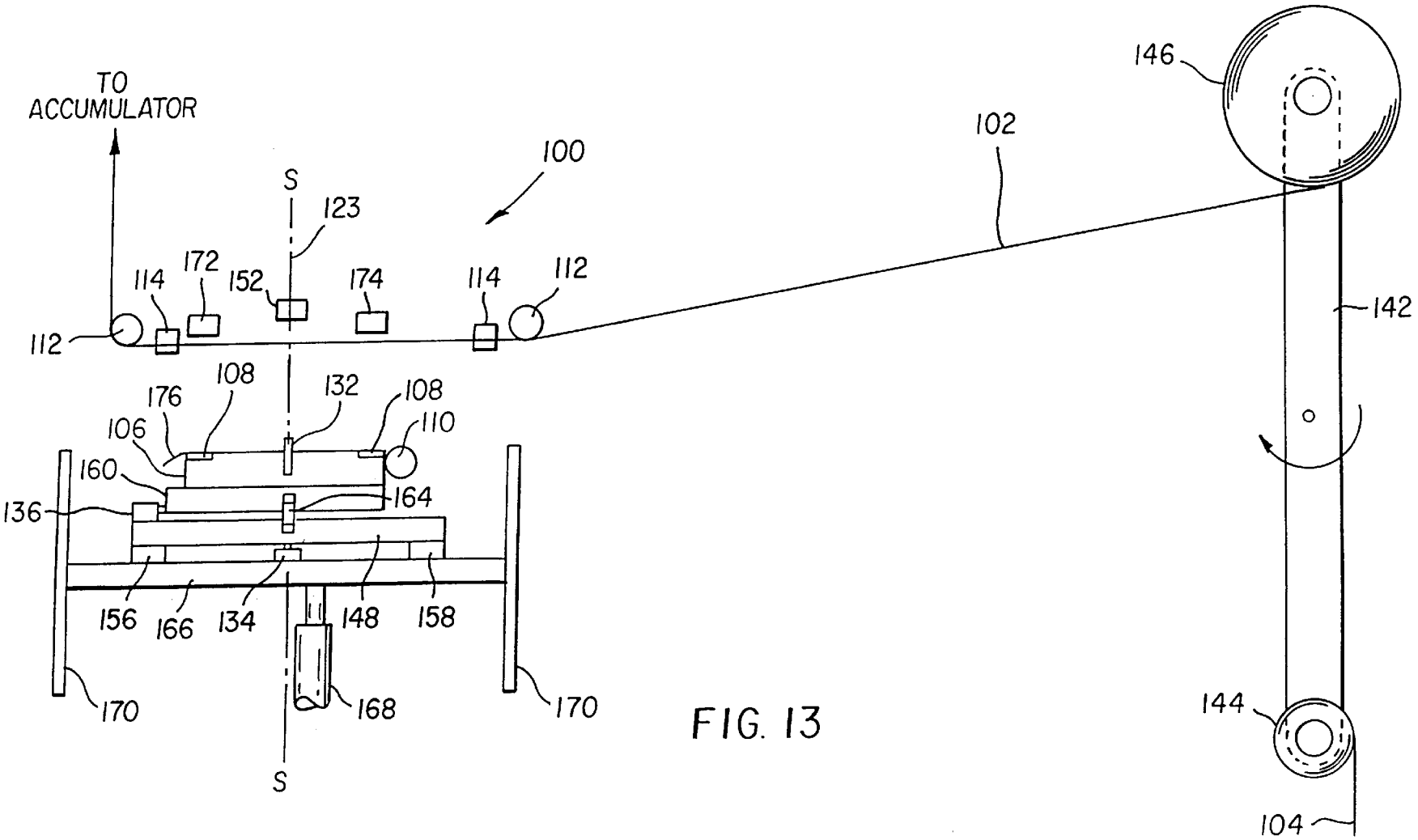

FIG. 13 shows the machine 100 sequence needed to get ready for the next splice operation. Unwind turret 142 rotates 180 degrees. Third actuator 168 retracts third frame 166 on guide rails 170 into the splice preparation position. The operators remove the piece of fresh web scrap 176 adds tape 150 to tape head 152 and replaces expiring web roll 144, with a fresh roll, allowing the splice cycle to be repeated again.

A skilled artisan will appreciate that the fresh and expiring web materials 102, 104 may be paper, plastic films and the like. This invention is important in continuous operating converting machine where the lateral position of the running web is important for registration of something being applied to (e.g. photographic emulsion) the running web.

The invention has therefore been described with reference to certain embodiments thereof, but it will be understood that variations and modifications can be effected within the scope of the invention.

We claim:

1. Apparatus for moving a first, fresh web into registered alignment with a second, expiring web, comprising:

means for movably supporting said first, fresh web in a tension-free, prearranged fixed position defined by a translational and a rotational metric corresponding to said prearranged fixed position, said movably supporting means being capable of movements in response to precisely sensed positions of said second, expiring web relative to said fixed position of said first, fresh web, said movements being defined by translational and rotational metrics and wherein said rotational metric is defined by the equation:

$$ROT = A_1 - A_2$$

wherein, $$A_1 = TAN^{-1}\left(\frac{E1 - E2}{L1 + L2}\right),$$

and, $$A_2 = TAN^{-1}\left(\frac{E3 - E4}{L3 + L4}\right),$$

and wherein;

$E_1$ and $E_2$ define expired web position errors measured by expired web sensor means;

$E_3$ and $E_4$ define fresh web position errors measured by fresh web sensor means;

$L_1$ and $L_2$ are distances the expired web is from a cutting means plane as sensed by expiring web sensor means; and, $L_3$ and $L_4$ define distance the fresh web is from a cutting means plane as detected by fresh web sensor means;

means for producing movements of the supporting means;

means for positioning the second, expiring web into proximity with said supporting means;

first sensor means in proximity of said supporting means and arranged for detecting said fixed position of said first, fresh web, said first sensor means generating a first signal;

second sensor means in proximity of said supporting means and arranged for detecting positions of said second, expiring web, said second sensor means generating a second signal; and controller means for receiving and processing said first and second signals, and then transmitting a third signal to said supporting means, said third signal corresponding to said precisely sensed positions of said expiring web relative to said fixed position of said fresh web, and wherein said third signal provides said supporting means with movements that laterally, registrably aligns the fresh web with the expiring web.

2. The apparatus recited in claim 1 wherein said prearranged fixed position of said fresh web is defined by a translational and a rotational metric of said fixed position; and wherein said precisely sensed positions of said expiring web are defined by a plurality of translational and rotational metrics of said precisely sensed positions.

3. The apparatus recited in claim 1, wherein said supporting means comprises an at least partially ported vacuum table for holding the fresh web in a fixed position thereon.

4. The apparatus recited in claim 1, wherein a just cut end trailing of said expiring web is alignably spaced from a just-cut leading end of said fresh web when said expiring web is in proximity with said supporting means.

5. The apparatus recited in claim 4 further comprising means for positioning said just-cut end of said expiring web into overlapping contact with the just cut end leading end of said fresh web thereby forming overlapping web ends.

6. The apparatus recited in claim 4 further comprising means for positioning said just cut trailing end of said expiring web into abutting contact with the just cut leading end of said fresh web forming thereby forming abutting web ends.

7. The apparatus recited in claim 5 or 6, wherein a splice material is applied across either of said overlapping or abutting web ends forming an aligned spliced web, and wherein said overlapping or abutting web ends comprise correspondingly aligned lateral edges.

8. The apparatus recited in claim 2, wherein said first sensor means provides measurements of said translational and rotational metrics of said fixed position of said fresh web; and wherein said second sensor means provides measurements of said plurality of translational and rotational metrics of said precisely sensed positions of said expiring web.

9. The apparatus recited in claim 8, wherein said expiring web has a rotational metric denoted by $A_1$ and a translational metric denoted by $O_1$.

10. The apparatus recited in claim 8, wherein said fresh web has a rotational metric denoted by $A_2$ and a translational metric denoted by $O_2$.

11. The apparatus recited in claim 9 wherein $$A_1 = TAN^{-1}\left(\frac{E1 - E2}{L1 + L2}\right)$$

-continued and $$O_1 = E_1\left(1 - \frac{L1}{L2 + L1}\right) + \frac{E2L1}{L2 + L1}$$

and, wherein, $E_1$ and $E_2$ are expired web sensor means measurements of web location errors; and wherein $L_1$ and $L_2$ are distances each of the sensor means is from a cutting means arranged for providing just-cut ends of the web prior to splicing.

12. The apparatus recited in claim 10 wherein $$A_2 = \text{TAN}^{-1}\left(\frac{E3 - E4}{L3 + L4}\right),$$

and $$O_2 = E_3\left(1 - \frac{L3}{L4 + L3}\right) + \frac{E4L3}{L4 + L3};$$

wherein, $E_3$ and $E_4$ define fresh web position errors measured by fresh web sensor means; and, $L_3$ and $L_4$ define distance the fresh web is from a cutting means plane as detected by fresh web sensor means.

13. The apparatus recited in claim 2, wherein said translational metrics of said supporting means are defined the equation $$\text{TRANS}=O_1-O_2$$

wherein, $$O_1 = E_1\left(1 - \frac{L1}{L2 + L1}\right) + \frac{E2L1}{L2 + L1}$$

and $$O_2 = E_3\left(1 - \frac{L3}{L4 + L3}\right) + \frac{E4L3}{L4 + L3};$$

and wherein;

$E_1$ and $E_2$ define expired web position errors measured by expired web sensor means;

$E_3$ and $E_4$ define fresh web position errors measured by fresh web sensor means;

$L_1$ and $L_2$ are distances the expired web is from a cutting means plane as detected by expiring web sensor means; and, $L_3$ and $L_4$ define distance the fresh web is from a cutting means plane as detected by fresh web sensor means.

14. The apparatus recited in claim 1 wherein said movements of said supporting means provided by said third signal cause a lateral edge of said fresh web to registerably align with a corresponding lateral edge of said expiring web.

15. Method of moving a first, fresh web into registered alignment with a second, expiring web, comprising the steps of:

providing a movably supporting means for supporting said fresh web in a prearranged fixed position;

movably supporting said first, fresh web free of tension, said movably supporting means being capable of movements in response to precisely sensed positions of said expiring web, said movements being defined by translational and rotational metrics and wherein said rotational metrics are defined by the equation:

$$\text{ROT}=A_1-A_2$$

wherein, $$A_1 = \text{TAN}^{-1}\left(\frac{E1 - E2}{L1 + L2}\right),$$

and, $$A_2 = \text{TAN}^{-1}\left(\frac{E3 - E4}{L3 + L4}\right),$$

and wherein;

$E_1$ and $E_2$ define expired web position errors measured by expired web sensor means;

$E_3$ and $E_4$ define fresh web position errors measured by fresh web sensor means;

$L_1$ and $L_2$ are distances the expired web is from a cutting means plane as sensed by expiring web sensor means; and, $L_3$ and $L_4$ define distance the fresh web is from a cutting means plane as detected by fresh web sensor means;

producing movement of the supporting mean;

positioning the second, expiring web into proximity with said supporting means;

providing means for sensing the positions of said first and second webs;

sensing the fixed position of said fresh web, said sensed position producing a first signal;

sensing the positions of said expiring web, said sensed positions producing a second signal providing a controller for receiving said first and second signals and then transmitting a third signal to said supporting means; and receiving and processing said first and second signals and then transmitting said third signal to said movable supporting means, said third signal corresponding to precisely sensed positions of said expiring web relative to said fixed position of said fresh web, and wherein said third signal provides said supporting means with movements that laterally, registrably aligns the fresh web with the expiring web.

16. The method recited in claim 15 further comprising the step of positioning an end of said expiring web into aligned abutting contact with an end of said fresh web thereby forming aligned abutting web ends.

17. The method recited in claim 15 further comprising the step of positioning an end of said expiring web into aligned overlapping contact with an end of said fresh web thereby forming aligned overlapping web ends.

18. The method recited in claims 16 or 17 further comprising the step of applying a splice material to either of said aligned abutting or overlapping web ends thereby forming aligned spliced web ends.

19. The method recited in claim 15 wherein said means for sensing the positions of said fresh and expiring webs measures rotational and translational metrics of said positions.

* * * * *

UNITED STATES PATENT AND TRADEMARK OFFICE

CERTIFICATE OF CORRECTION

PATENT NO. : 5,849,123
DATED : December 15, 1998
INVENTOR(S) : Brian S. Rice.

It is certified that error appears in the above-identified patent and that said Letters Patent is hereby corrected as shown below:

Column 7, line 55:
In the equation within claim 1, after "and, $A_2$ = TAN" and before the exponent numeral 1, insert a minus sign.

Column 10, line 9:
In the equation within claim 15, after "$A_1$ = TAN" and before the exponent numeral 1, insert a minus sign.

Signed and Sealed this

Fourth Day of May, 1999

*Attest:*

Q. TODD DICKINSON

*Attesting Officer*

*Acting Commissioner of Patents and Trademarks*